United States Patent [19]

Heater

[11] 4,338,086

[45] Jul. 6, 1982

[54] MACHINE FOR MAKING LONGITUDINAL AND TRANSVERSE FOLDS IN FABRIC

[76] Inventor: Charles P. Heater, Boys Camp Rd., Lake Lure, N.C. 28746

[21] Appl. No.: 182,269

[22] Filed: Aug. 29, 1980

[51] Int. Cl.[3] ..... B65H 45/14

[52] U.S. Cl. ..... 493/419; 493/443; 493/455; 493/458

[58] Field of Search ..... 493/405–408, 493/413–414, 418, 446, 442–445, 455, 457, 458–459, 249, 419; 223/37; 271/303

[56] References Cited

U.S. PATENT DOCUMENTS

| | | | |
|---|---|---|---|
| 3,134,587 | 5/1964 | Sjostrom | 493/444 |
| 3,768,226 | 10/1973 | Glaze | 223/37 |
| 3,806,007 | 4/1974 | Grantham | 223/37 |
| 3,984,094 | 10/1976 | Stocker | 271/303 |

*Primary Examiner*—Edgar S. Burr
*Assistant Examiner*—A. Heinz
*Attorney, Agent, or Firm*—Clifton T. Hunt

[57] ABSTRACT

A manually fed folding machine comprising a horizontally reciprocal fold plate for making a first fold in an article, a pivotally movable fold bar clamps the leading edge of the article while the first fold is made and then unclamps the leading edge and carries it about a second predetermined fold line and into superposed relation with the first fold line. A vertically reciprocable fold knife is pivotally connected to spring-clip clamps and the vertically reciprocable fold knife is elevated to move the clamps into clamping position against the article during the second fold and the fold knife is then lowered against the article to impart a third fold while simultaneously lifting the clamps from the article.

7 Claims, 7 Drawing Figures

MACHINE FOR MAKING LONGITUDINAL AND TRANSVERSE FOLDS IN FABRIC

BACKGROUND OF THE INVENTION

Machines for folding fabric have long been known, including machines for making longitudinal folds and transverse folds as in the present invention. Such machines of the prior art of which applicant is aware are generally large and expensive machines utilizing conveyors to transport the material from one fold station to another and occupying a lot of valuable floor space. See, for example, U.S. Pat. No. 4,060,227 issued Nov. 29, 1977 to Landgraf et al. The conveyors and folding mechanisms of the prior art are specifically built to accommodate a specific size of article to be folded, so that a machine built to fold regular size pillowcases, for example, must be modified, if possible, to fold king size pillowcases.

SUMMARY OF THE INVENTION

According to the present invention, the folding machine need have a width only slightly greater than the greatest length of the articles to be folded and an overall length from front to back only slightly greater than one and one-half times the greatest width of the articles to be folded, and thereby occupies a minimum of floor space. The machine can be used to fold any desired article longitudinally and transversely and will be described as being used to fold pillowcases.

Successive pillowcases are manually fed to the machine by placing the trailing longitudinal edge of each pillowcase against an appropriate index line at the rear of a feed table on the rear of the machine and arranging the leading longitudinal edge of the pillowcase to overhang a vertical abutment spaced forwardly from the said index line. The machine is then actuated and cam activated to perform a series of sequential steps to automatically place two longitudinal folds and selected transverse folds in the pillowcase before discharging it to a stacking station.

After the machine is actuated the control cam causes a combination hold and fold bar to grip the leading longitudinal edge of the pillowcase between the bar and the vertical abutment. After the leading longitudinal edge of the pillowcase is gripped by the pivotal bar, the control cam actuates the horizontal fold plate to move forwardly from beneath the table and against the lower surface of the pillowcase to draw the pillowcase forwardly over the pivotal bar while drawing the trailing longitudinal edge of the pillowcase into overlying relation with the gripped leading longitudinal edge of the pillowcase. When the leading and trailing longitudinal edges of the pillowcase are in superposed relation, the movable fold plate has reached the longitudinal fold station and formed a first longitudinal fold along the longitudinal center line of the pillowcase. The pillowcase is then clamped adjacent the said center fold line preparatory to making the next fold at the longitudinal fold station as the horizontally movable fold plate withdraws rearwardly to its inactive position beneath the feed table.

Then, while the mid-portion of the pillowcase is clamped, the pivotal bar is activated to rise upwardly and forwardly carrying the leading and trailing edges of the pillowcase forwardly across the rear edge of a stationary fold plate spaced above the first longitudinal fold at the longitudinal fold station to form a second longitudinal fold against said rear edge of the stationary fold plate with the leading and trailing edges overlying the first longitudinal fold of the pillowcase.

The pivotal bar returns to the abutment after it has placed the leading and trailing edges of the preceding pillowcase in overlying relation to the longitudinal center of the pillowcase and clamps the leading longitudinal edge of a succeeding pillowcase against the abutment while a vertically movable first transverse fold knife positioned at the longitudinal fold station moves downwardly to define a transverse fold in the longitudinally folded pillowcase as the clamping fingers release the pillowcase and permit it to be moved from the longitudinal fold station to a first transverse fold station where a second transverse fold knife places a second transverse fold in the pillowcase. The pillowcase is then moved selectively to a stacking station or to a third transverse fold knife and then to a stacking station. The operation is then repeated with successive pillowcases.

The machine does not use conveyors to transport the articles while folding, does not use grippers spaced from each other a distance equal to a dimension of the article being folded, and other than the overall dimensions of the machine, does not utilize any mechanism dependent on the size of the articles being folded to perform its intended function. Thus, a single machine according to the invention can be used to fold different sizes of an article, such as regular, queen and king size pillowcases without structural modification.

DETAILED DESCRIPTION OF THE INVENTION

Figure 1:
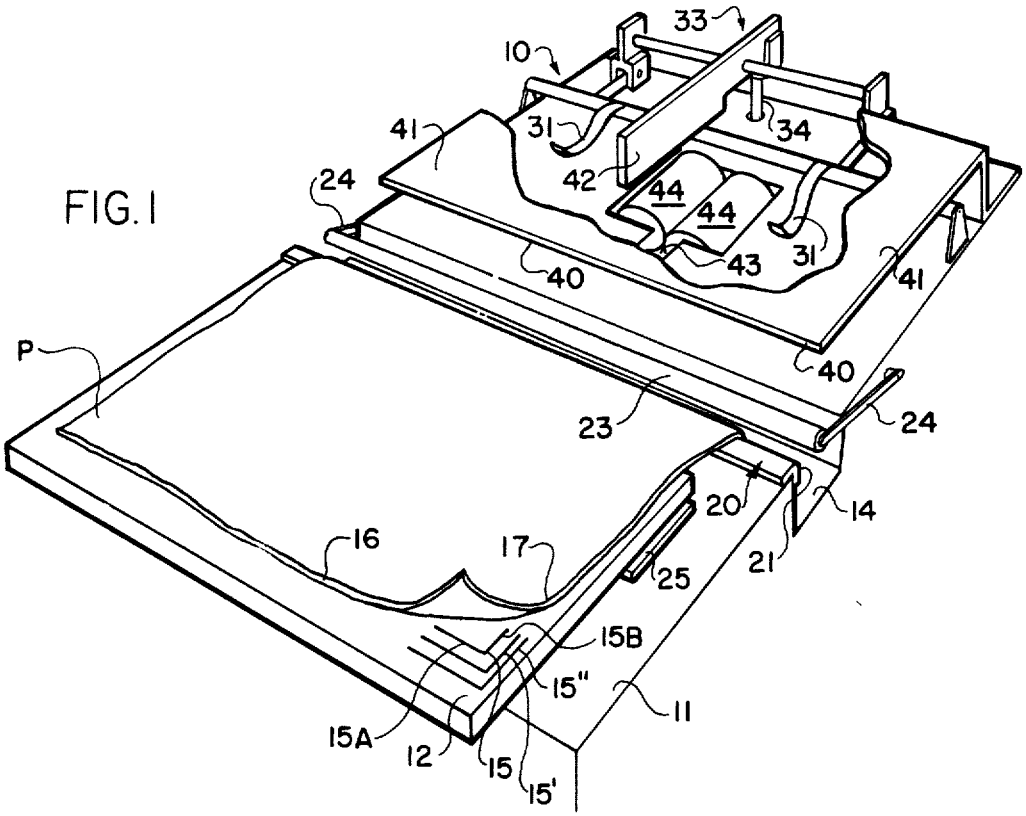
FIG. 1 is a perspective view looking at the rear and one side of a folding machine, with parts broken away for purposes of clarity.

Referring more specifically to the drawings, the numeral 10 broadly indicates a first fold station where two longitudinal folds and one transverse fold are placed in a desired textile material or article without moving the article except to form the folds. The invention has been used satisfactorily with regular size, queen size and king size pillowcases and the illustrated embodiment will be described in association with pillowcases, although the machine is also useful in folding other articles.

The machine includes a frame 11 and a feed table 12 spaced above the rearward end portion of the frame. The frame includes a fold portion 13 spaced forwardly from the feed table 12 at the first fold station 10 and a U-shaped channel or trough 14 between the feed table 12 and first fold station 10.

A right angular index line 15 is marked on the upper surface of the feed table 12 to mark the proper location of the trailing longitudinal edge and the proximal side edge of successive regular size pillowcases P. Thus, in FIG. 1 the trailing longitudinal edge 16 of pillowcase P is placed on the segment 15*a* of reference line 15 and the proximal side edge 17 is placed on the segment 15*b* of reference line 15. The machine will fold larger sizes of pillowcases without modification of the machine and for this purpose additional index lines 15' and 15'' are provided for queen and king sized pillowcases, respectively.

An abutment 20 preferably covered with resilient material and having a vertical face 21 is located at the rear of the channel 14 with the vertical wall 21 extending into the channel.

Figure 5:
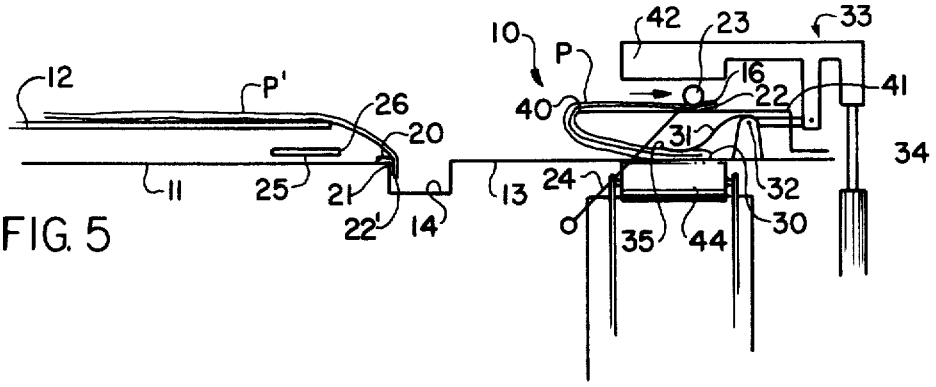

The index lines 15, 15' and 15'' are spaced from the abutment 20 a distance slightly less than the width of the respectively sized pillowcases being folded so that when a pillowcase is positioned on the feed table 12 with its trailing longitudinal edge 16 and its proximal side edge 17 located on the appropriate index line 15, 15' or 15'', the leading longitudinal edge 22 of the pillowcase will overhang the abutment 20 and lie against the vertical face 21 of abutment 20. A pivotal rod 23 extends between links 24 journaled on a pivoting mechanism, not shown, to move the rod 23 between its rearmost position against the vertical face 21 of abutment 20 (FIGS. 2, 3 and 6) and its forward position at fold station 10, as indicated in FIG. 5.

Figure 2:
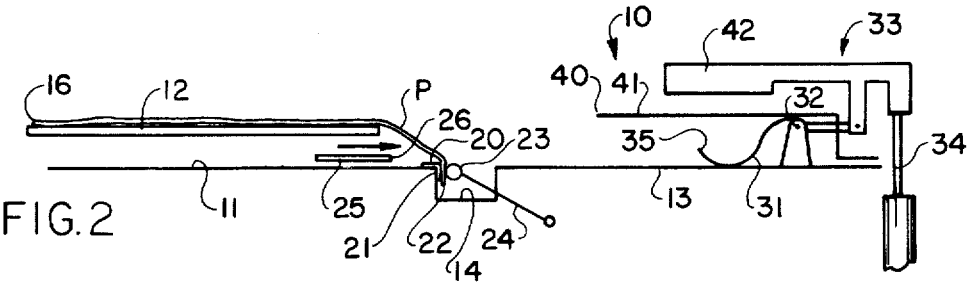
FIGS. 2–6 are successive schematic side elevations of the folding machine showing the successive steps of folding a pillowcase with two longitudinal folds and one transverse fold at the longitudinal fold station.
Figure 3:
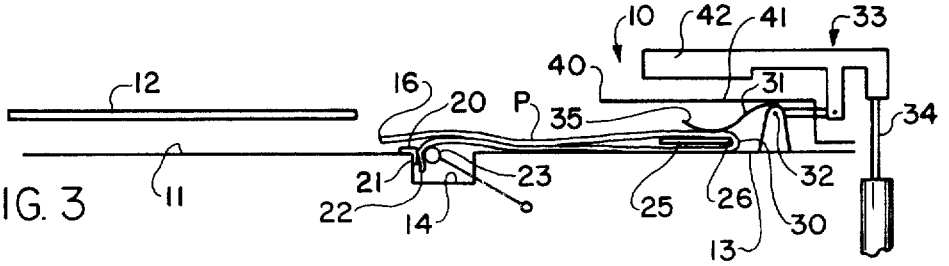
Figure 6:
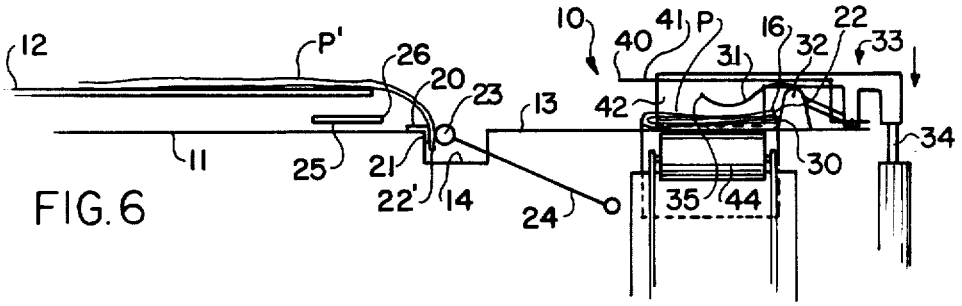

The rod 23 is preferably covered with a resilient material and in its rearmost position of FIGS. 2, 3, and 6 the rod 23 presses against the leading edge portion 22 of a pillowcase P to hold the leading edge portion of the pillowcase between the vertical abutment face 21 and the rod 23. The feed table 12 is elevated above the frame 11 and horizontally movable fold plate 25 normally rests beneath the feed table 12 when the fold plate 25 is in its inactive position.

In FIG. 2, the horizontally movable fold plate 25 is shown in its inactive position beneath the feed table 12 with the trailing longitudinal edge 16 and proximal side edge 17 of a pillowcase P placed on the index line 15 (FIG. 1) and the leading longitudinal edge 22 of the pillowcase P overhanging the vertical face 21 of the abutment 20. The leading edge portion 22 of the pillowcase P is held against the vertical face 21 of the abutment 20, the horizontally movable fold plate 25 is moved forwardly across the abutment 20 toward fold station 10 and against the pillowcase P, drawing the trailing edge 16 of the pillowcase across the feed table 12 and into substantially superposed relation with the leading longitudinal edge 22 of the pillowcase P at the abutment 20 as shown in FIG. 3.

FIG. 3 illustrates the horizontally movable fold plate 25 in its forward-most position at fold station 10 after it has traversed one-half the width of the pillowcase P so that the forward edge 26 of fold plate 25 rests against the longitudinal axis or center line 30 of the pillowcase P (FIG. 3). The trailing edge 16 of the pillowcase is thereby brought into substantial alignment with the leading edge 22 of the pillowcase as it remains gripped between the vertical face 21 of the abutment 20 and the pivotal rod 23.

As the horizontally movable fold plate 25 moves to its forwardmost position as shown in FIG. 3, it carries the medial portion of the pillowcase P beneath a pair of spring clips 31 curved downwardly from their front end pivotal connection 32 with a pneumatic piston and cylinder arrangement broadly indicated at 33. The piston 34 of the piston and cylinder arrangement 33 is normally in its extended or upward position as shown in FIGS. 1–5 which causes the spring clips 31 to pivot downwardly into snug engagement with the top surface of the fold portion 13. The spring clips 31 are curved upwardly so that their rear ends 35 are elevated above the top of the fold portion 13 to provide clearance for the horizontally movable fold plate 25 and the pillowcase carried thereby to overcome the spring tension of the clips and pass beneath them as shown in FIG. 3.

The horizontally movable fold plate 25 is withdrawn rearwardly to its inactive position beneath the feed table 12 after the axial portion of the pillowcase P has been brought beneath the clips 31 (FIG. 4), at which time the tension in the spring clips 31 moves them toward the fold table 13 and snugly holds the axial portion of the pillowcase between the clips 31 and the top surface of fold portion 13.

Figure 4:
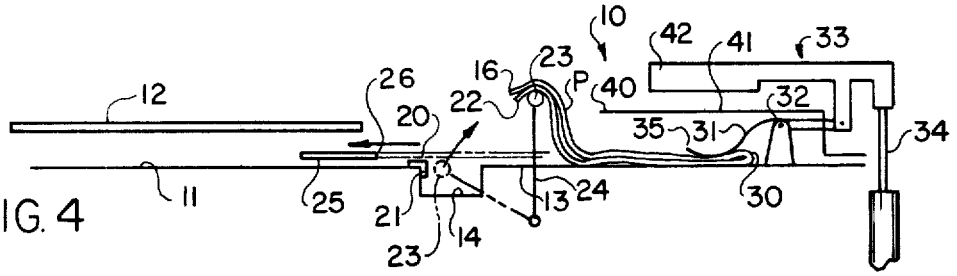

After the horizontally movable fold plate 25 has returned to its inactive position beneath the feed table 12, the pivotal rod 23 moves from its dotted line position against the abutment 20 in FIG. 4 upwardly and forwardly to the intermediate solid line position in FIG. 4 and then to the forward-most position of FIG. 5, carrying with it the trailing and leading edges 16, 22 of the pillowcase and moving the pillowcase against the rear edge 40 of a stationary fold plate 41 spaced above the fold portion 13 at fold station 10.

The rear edge 40 of stationary fold plate 41 is spaced rearwardly from the point of foremost travel of movable fold plate 25 (occupied by the axis 30 of pillowcase P in FIGS. 3–6), a distance equal to one-quarter of the width of pillowcase P or at such other distance as is desirable to make the second longitudinal fold. It will be understood that the invention contemplates that the travel of the movable fold knife may be such as to make a quarter fold or other desired longitudinal fold instead of the described center fold, if desired.

While the pivotal rod 23 is in the forward position of FIG. 5, the operator places the trailing edge of a succeeding pillowcase P' against the appropriate index line 15, 15' or 15'' with the leading edge 22' overhanging the abutment 21 (FIG. 5). The control cam, not shown, moves the pivotal rod 23 rearwardly toward the abutment 20 after the leading and trailing edges 16, 22 have been brought forwardly into superposed relation with the longitudinal axis 30 of the pillowcase (FIG. 5). The rod 23 approaches the abutment 20 and after the leading edge 22' of pillowcase P' overhangs the abutment 20, the rod 23 engages the pillowcase P' and holds it against the vertical face 21 of the abutment, as seen in FIG. 6.

At the same time, the control cam, not shown, activates the pneumatic rod and piston assembly 33 causing the rod 34 to move downwardly into the cylinder and causing the spring clips 31 to pivot upwardly and release the pillowcase P. Simultaneously, the air and piston assembly 33 moves a vertically movable fold knife 42 downwardly to transversely fold the first pillowcase P at the first fold station. The stationary fold plate 41 has an opening 43 communicating with the rear edge 40 of fold plate 41, the opening 43 accommodating the vertically movable fold knife 42 as it moves downwardly to make the first transverse fold in the pillowcase.

Figure 7:
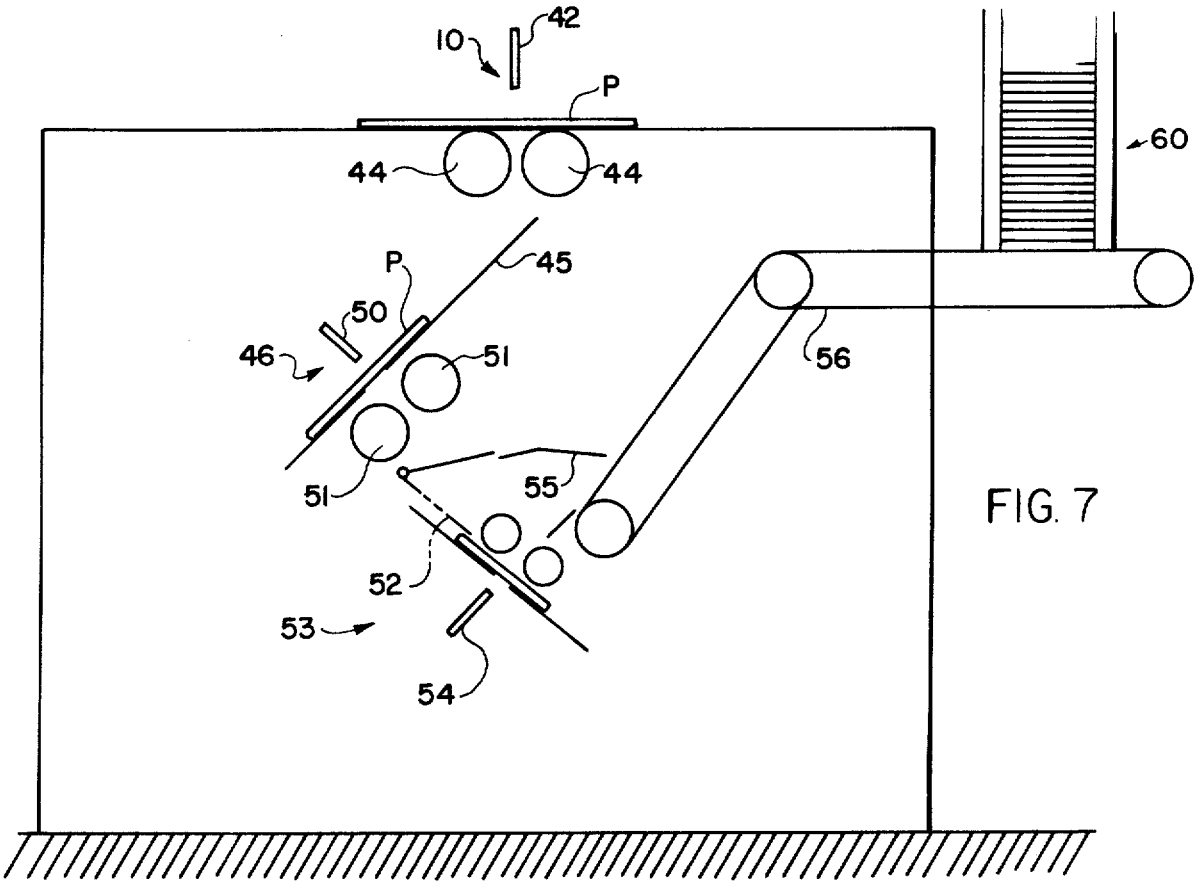
FIG. 7 is a schematic front elevation illustrating the transverse fold stations and means for delivering the folded pillowcases to a stacking machine

A pair of rolls 44 extend above the fold portion 13 of frame 11 and the vertical fold knife 42 registers with the nip of the rolls 44 to move the pillowcase P between the rolls 44 as the knife 42 makes the transverse fold in the pillowcase P. The rolls 44 feed the pillowcase P to a slide or other suitable conveyor 45 which delivers the pillowcase P to a second fold station 46 where a second transverse fold knife 50 places a second transverse fold in the pillowcase P. Knife 50 moves pillowcase P into the nip of rolls 51 which deliver the pillowcase P to a selectively movable pivoted conveyor plate 52 which, in the dotted line portion of FIG. 7, conveys the pillowcase P to a third fold station 53 beneath the first fold station 10. A fold knife 54 places a third transverse fold where desired in elongated articles such as king sized pillowcases. Alternatively, the pivoted conveyor plate 52 may be adjusted to the solid line position of FIG. 7 where it directs successive pillowcases as of the regular and queen size to an intermediate conveyor 55 that bypasses the third fold station 53 and delivers the folded pillowcases to an outlet conveyor 56 which conveys the folded pillowcases to a stacking mechanism 60. The elongated articles or king sized pillowcases that receive a third transverse fold at fold station 53 are moved by fold knife 54 into the nip of rolls 57 which deliver the folded pillowcases to outlet conveyor 56 for passage to stacking mechanism 60.

There is thus provided an improved folding machine which defines a pair of longitudinal folds and a transverse fold in articles of different sizes at a single folding station and then additionally folds it transversely a desired number of times at successive fold stations with a minimum of moving parts and with a minimum of floor space.

I claim:

1. In a machine for folding fabric articles having in opposed relationship a leading edge and a trailing edge and said machine having a substantially horizontal frame extending between the rear and front of the machine, a first folding station including the combination of a feed table at the rear of the frame, an abutment spaced forwardly of the feed table a distance less than the corresponding dimension of an article to be folded, means for positioning an article to be folded at a predetermined position on the feed table with the trailing edge of the article at a predetermined position on the feed table and with the leading edge of the article overlying the abutment, a stationary fold plate having a rear edge spaced forwardly from the abutment a desired distance to provide an edge about which the article is folded, a pivotal rod movable between a first position against the abutment and a second position located forwardly of the rear edge of the stationary fold plate, means for moving the pivotal rod to the first position to clamp against the abutment the leading edge of an article occupying said predetermined position, means for folding the article about a first fold line to position the trailing edge of said article in overlying relation to its leading edge and for positioning said article in overlying relation to the pivotal rod while the pivotal rod clamps the leading edge of the article against the abutment, and means for moving the pivotal rod and the overlying trailing and leading end portions of the article to said second position thereby folding the article about the rear edge of the stationary fold plate.

2. A structure according to claim 1 and including means for forming a third fold in said article at said first fold station.

3. A structure according to claim 2 including a vertically movable piston, spring-clip clamping means pivotally connected to said piston, and said piston normally moving the spring-clip clamping means into clamping relation with the article being folded and movable to release the article between folds.

4. A structure according to claim 3 wherein a fold knife is attached to said vertically movable piston and movable therewith, whereby downward movement of the piston carries the fold knife downwardly while simultaneously elevating the spring clip clamping means.

5. A structure according to claim 4 wherein a pair of rolls having a nip are positioned beneath the vertically movable fold knife with the nip of the rolls registrable with the fold knife in its lowest position, whereby lowering of the vertically movable fold knife moves the knife against the article and between the rolls to complete a fold of the article.

6. A folding machine according to claim 1 wherein means are provided for delivering the article from the first folding station to a second folding station, means at said second folding station for imparting a transverse fold to said article, means for selectively delivering the article from the second folding station to an outlet conveyor or to a further folding station, and means for delivering the article from said further folding station to said outlet conveyor.

7. A folding machine for placing a plurality of folds in an article at a single fold station, said machine having a substantially horizontal frame extending between the rear and front of the machine comprising means for positioning successive articles at a predetermined position relative to the said folding station preparatory to beginning the folding operation, each of said articles having a leading edge and a trailing edge, an abutment spaced forwardly from said positioning means a distance less than the width of the article to enable the leading edge of an article to extend over the abutment when the article is positioned in said predetermined position, means for holding the leading edge of the article at the abutment, a horizontally movable fold plate normally occupying an inactive position rearwardly of said abutment, means for moving said horizontally movable fold plate forwardly across the abutment to engage the article at the abutment and draw it forwardly from the abutment over said holding means to a first to form a first fold in the article is held against the abutment, means for returning the horizontally movable fold plate to its inactive position rearwardly of the abutment, said means for holding the leading edge of the article against the abutment while the first fold is made by said horizontally movable folding plate comprising a pivotal rod, a stationary fold plate mounted in superposed relation to said first fold line, said stationary fold plate having a rear edge spaced rearwardly from said first fold line sufficiently to form a second predetermined fold line, means for moving the pivotal rod away from the abutment and carrying the overlying leading edge of the article forwardly of the rear edge of the stationary fold plate and into superposed relation with said first fold, whereby a second fold is formed around the second predetermined fold line at the rear edge of the stationary fold plate.

* * * * *